United States Patent [19]

Warsop

[11] 4,229,953

[45] Oct. 28, 1980

[54] STITCH BONDED FABRIC

[75] Inventor: David H. Warsop, Blackburn, England

[73] Assignee: Cosmopolitan Textile Company Limited, Cheshire, England

[21] Appl. No.: 933,843

[22] Filed: Aug. 15, 1978

[30] Foreign Application Priority Data

Aug. 16, 1977 [GB] United Kingdom ..... 34268/77

[51] Int. Cl.[2] ..... D04B 23/08; D04B 23/10

[52] U.S. Cl. ..... 66/193; 66/190

[58] Field of Search ..... 66/194, 192, 195, 191, 66/190, 193, 85 A, 202

[56] References Cited

U.S. PATENT DOCUMENTS

| | | | |
|---|---|---|---|
| 3,365,918 | 1/1968 | Hughes | 66/85 X |
| 3,664,157 | 5/1972 | Kochta et al. | 66/192 |
| 3,672,187 | 6/1972 | Simpson | 66/192 |
| 3,967,472 | 7/1976 | Wildeman et al. | 66/192 X |
| 3,992,904 | 11/1976 | Webb et al. | 66/190 |

*Primary Examiner*—Ronald Feldbaum

*Attorney, Agent, or Firm*—Oblon, Fisher, Spivak, McClelland & Maier

[57] ABSTRACT

A stitch knitted fabric, for example a stitch bonded web of fibres, is made on a two guide bar machine with the front bar (which may exhibit missed thread patterning) knitting pillar stitches and the back bar (which may have part, for example, half set threading) forming stitches and/or laid-in sections and/or floats of thread extending over at least two wales of the front bar system and repeating over not less than four courses, the back bar system distorting, through thread tension, the front bar system and/or filling to give a pattern or texture effect.

14 Claims, 8 Drawing Figures

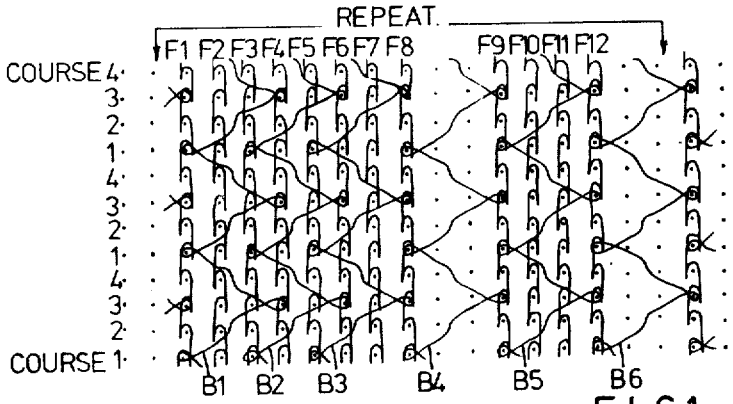
-FIG.1-
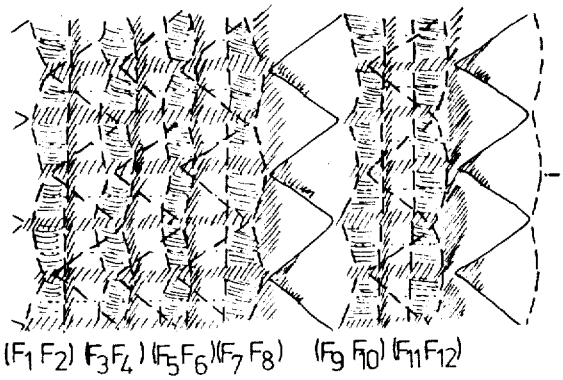
-FIG.2-
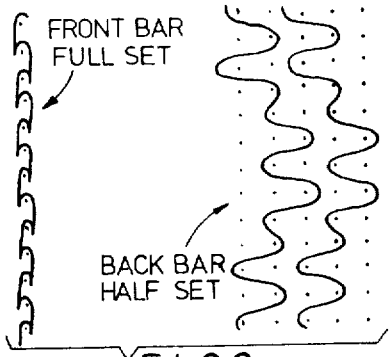
-FIG 3-
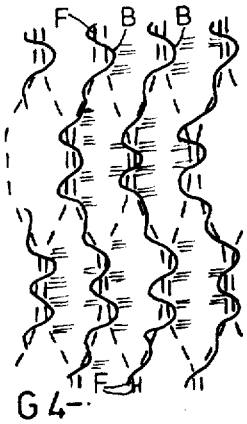
-FIG 4-

-FIG.5.-
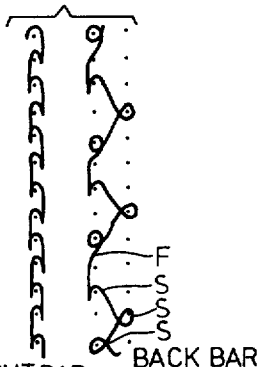
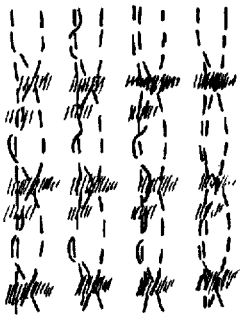
-FIG.6.-
-FIG.7.-
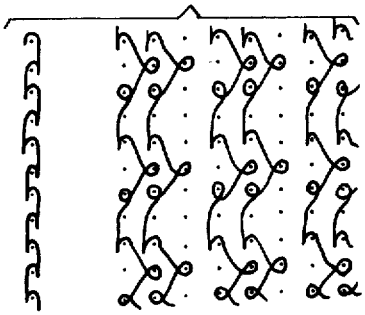
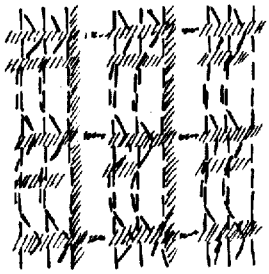
-FIG.8.-

STITCH BONDED FABRIC

BACKGROUND OF THE INVENTION

1. Field of the Invention

This invention relates to stitch knitted fabric in which a filling is knitted through with front and back guide bar warp thread systems.

The invention has particular reference to stitch bonded fabrics in which the filling is a fibre fleece, usually a cross-folded card web. Other types of filling, of course, include for example a sheet of weft threads or a sheet of foamed plastics material.

2. Description of the Prior Art

Two guide bar fabrics have been manufactured in which the front and back bars knit with different stitch systems. Reasons for using two independent thread systems in stitch bonded production include the production of more interesting surface texture or pattern effects, improved weft-way strength, and the avoidance of laddering. In a well known arrangement, one bar knits pillar stitch while the other bar knits tricot stitch. In another arrangement, both bars knit mirror-image systems extending over two or more needles.

Pattern effects are also achieved—even in single guide bar stitch bonding machinery—by the use of half set or otherwise incomplete threading. Missing out a single thread occasionally from a ground of pillar stitch gives rise to a lengthwise stripe or rib. Pattern effects have also been produced by the incorporation of a laid-in effect thread substantially without tension in a ground of pillar stitch, which shows up for example as a zig-zag line or a wavy stripe, if several such threads are laid-in in a block.

However, stitch bonded fleece fabrics, even with these various pattern or texture effects, have always had a relatively flat surface or an essentially lengthwise ribbed texture somewhat resembling a cord cloth. Lengthwise ribbiness can to some extent be reduced by avoiding the pillar stitch and knitting tricot stitch formation on both bars—or perhaps more complicated zig-zag patterns—but the physical properties of such fabrics, particularly as regards lengthwise stability, are considerably inferior to those of fabrics that have pillar stitch on one bar.

SUMMARY OF THE INVENTION

The present invention provides two guide bar stitch knitted fabrics having novel pattern or texture effects and good physical properties, in particular, lengthwise stability.

The invention comprises a two guide bar stitch knitted fabric comprising a filling and front and back bar warp thread systems of which the front bar system comprises pillar stitches and the back bar system repeats over not less than four courses, its threads passing between at least two wales of the front bar system and comprising fewer stitches in a repeat than the number of courses in the repeat, the back bar system distorting, through tension in its threads, the front bar system and/or filling, to give a pattern or texture effect. By 'stitch' is meant the result of an overlap, where the thread is laid into the hook of the needle.

The back bar system may comprise laid in sections of thread, or stitches and laid in sections, or stitches and floats, or stitches and both laid in sections and floats.

A 'laid in' section is a section of back bar thread that is not formed into a stitch but which is trapped between the filling and the underlays of the front bar thread. A 'float' is a section of back bar thread that is not formed into a stitch and is not trapped by the front bar thread but floats on the technical back, i.e. the underlap side of the fabric. The pillar stitch on the front bar gives the fabric desired lengthwise stability, while the distorting effect of the back bar system can be used to produce a wide variety of patterning or texture effects.

The front bar system may exhibit missed thread patterning, in which one thread, or, in finer gauges, two adjacent threads, can be omitted, usually to a predetermined pattern. The back bar system may, and in most cases will, exhibit part set threading, such as half set threading, or a missed thread every third or fourth wale.

One effect that can be produced in accordance with the invention is a simulated raised cable stitch formation. A single, or preferably a double missed thread wale on the front bar system is crossed by floats of the back bar system. Tension in the floats pulls in the front bar pillar stitch wales either side of the missed thread wale, which bunches up the filling in between to stand proud of the adjacent pillar stitched regions, while the floats extending diagonally across the raised filling impart a cabled or twisted appearance.

A waffle effect is produced when the back bar system comprises a system of laid in sections extending alternatively between first and second pairs of wales of the front bar system.

A hopsack fabric is simulated when the back bar system comprises three or more courses of tricot stitch followed by one or more course of float and/or laid in sections in the repeat. This effect is enhanced by half set threading of the back bar system or by other part set threading systems.

The invention also comprises a method for making a two guide bar stitch knitted fabric in which the front bar knits pillar stitch and the back bar executes a lapping motion which repeats over not less than four courses, which extends over at least two needles, and which executes fewer overlaps in the repeat than the number of courses in the repeat, the back bar warp threads being under tension so as to distort the front bar system and/or filling to give a pattern or texture effect.

The distorting effect will of course depend on the tension in the back bar threads, which can be adjusted to produce the exact effect desired. Normally, the tension in each back bar thread will be somewhat higher than the tension in each front bar thread, and both may be controlled in the usual way by positive feed let off from the beam and by the tension rail.

BRIEF DESCRIPTION OF THE DRAWINGS

Embodiments of fabrics and methods for making them according to the invention will now be described with reference to the accompanying drawings in which:

FIG. 1 is a lapping pattern for a first fabric,

FIG. 2 shows a stitched bonded fleece fabric made with the lapping motions illustrated in FIG. 1, FIG. 3 is a lapping motion for another fabric, FIG. 4 is the fabric produced by the lapping motions shown in FIG. 3, FIG. 5 is a lapping motion for a third fabric, FIG. 6 is the fabric produced by the motion shown in FIG. 5, FIG. 7 is a lapping motion for a fourth fabric, and FIG. 8 is the fabric produced by the motion of FIG. 7.

DETAILED DESCRIPTION OF THE PREFERRED EMBODIMENTS

FIGS. 1 and 2 illustrate a two guide bar stitch bonded fleece fabric having an open pillar stitch warp thread system on the front bar and a back bar system which repeats over four courses, the threads passing through four wales of the front bar system, and having two stitches in each repeat. Between stitches, the back bar threads have laid in sections crossing over adjacent wales.

The front bar exhibits double missed thread wales and in fact has a repeated threading pattern 1111111100111100, while the back bar is threaded 1010100100100100, where "1" indicates the presence of a thread and "0" indicates a missed thread.

It will be seen that some of the back bar threads, namely B1, B2, B3 and B5 lie wholly within the regions of front bar pillar stitch wales. Tension in these threads has the effect of pulling the front bar wales F1 to F8 into pairs (F1,F2), (F3,F4), (F5,F6) and (F7,F8) so as to accentuate lengthwise ribbiness by bunching up the fleece fibres in between the wale pairs. It also has the effect of accentuating the transverse ribbing of the fleece into well defined transverse rib pairs between the courses of back bar stitches. This accentuated walewise and coursewise ribbing gives the fabric ground between the front bar missed thread wales a woven appearance.

Tension in the back bar thread floats B4, B6 that cross the front bar missed thread wales has the effect of pulling together the adjacent front bar thread wales which causes the intervening fleece to bunch up and stand proud of the ground—there is no stitch in this region to hold the fleece down. The fibres bunch up around the floats giving the appearance of a raised cable stitch formation.

FIGS. 3 and 4 illustrate the production of a waffle effect. The front bar knits a full set of pillar stitches, while the back bar, with half set threading, simply lays in threads over three wales which alternatively connect the two right hand wales and the two left hand wales of the three wales covered. Tension in the laid in threads pulls the front bar stitch wales F together wherever they are connected by the laid in back bar threads B. The fleece fibres billow out into small cushion like formations between the distorted stitches on the technical back. The technical front of the fabric has a different though equally attractive waffle appearance, with small ridges of fibre raised up between the stitch chains where they are pulled together.

FIGS. 5 and 6 and FIGS. 7 and 8 illustrate the production of two different hopsack effect fabrics. That shown by FIGS. 5 and 6 has a full set of pillar stitch on the front bar, and on the back bar, with half set threading, a sequence of stitches S first on one needle, then on an adjacent needle, then back to the first needle followed by a float F, as a repeated pattern. In the conventional notation, the lapping motion would be described as the sequence, 1-0/1-2/1-0/0-0/repeat.

The fabric illustrated by FIGS. 7 and 8 is similarly produced except that the back bar is threaded 110110110 etc.

Tension in the back bar threads pulls the front bar wales of pillar stitches into groups of two (FIGS. 5 and 6) or three (FIGS. 7 and 8), enhancing the lengthwise ribbed effect of the front bar wales. The coursewise alternation of stitches and float on the back bar gives rise to a transverse ribbing effect. The combination of effects give an appearance characteristic of hopsack weave.

Although it is of prime importance from the point of view of lengthwise stability that there should be a pillar stitch formation maintained throughout on the front bar, this is not to say that minor divergences from this requirement cannot be made. It would be perfectly possible, for example, to achieve some special effect by introducing occasional tricot stitches instead of pillar stitches. This would affect the lengthwise stability, but perhaps within acceptable limits.

Open pillar stitch has been shown in the examples illustrated. Closed pillar stitch could be used instead if desired.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A two guide bar stitch knitted fabric comprising a filling and front and back bar warp thread systems of which the front bar system comprises pillar stitches, characterised in that the back bar system repeats over not less than four courses, its threads passing between at least two wales of the front bar system, and comprises fewer stitches in a repeat than the number of courses in a repeat, the back bar system distorting, through tension in its threads, the front bar system and/or filling to give a pattern or texture effect.

2. A fabric according to claim 1, characterised in that the back bar system comprises laid in sections of thread.

3. A fabric according to claim 1, characterised in that the back bar system comprises stitches and laid in sections of thread.

4. A fabric according to claim 1, characterised in that the back bar system comprises stitches and thread floats on the front face.

5. A fabric according to claim 1, characterised in that the back bar system comprises stitches and laid in sections of thread and thread floats on the front face.

6. A fabric according to claim 1, characterised in that the front bar system exhibits missed-thread patterning.

7. A fabric according to claim 1, characterised in that the back bar system exhibits incomplete threading.

8. A fabric according to claim 1, characterised in that single or double missed thread wale of the front bar system is crossed by floats of the back bar system to simulate a raised cable stitch formation.

9. A fabric according to claim 8, characterised in that a double missed thread wale of the front bar system is criss-crossed by a back bar thread float over both wales.

10. A fabric according to claim 2, in which the back bar system comprises a series of laid in sections extending alternately between first and second pairs of wales of the front bar system, so as to result in a waffle effect.

11. A fabric according to claim 1, in which the back bar system comprises three courses of tricot stitch followed by one course of float or laid in section in the repeat, so as to simulate a hopsack fabric.

12. A fabric according to claim 11, characterised in that the back bar system has half set threading.

13. A fabric according to claim 11, characterised in that the back bar system exhibits missed threading every third wale.

14. A fabric according to claim 1, characterised in that the filling is a fibre fleece.

* * * * *